US005598173A

United States Patent [19]

Lo Forti et al.

[11] Patent Number: 5,598,173

[45] Date of Patent: Jan. 28, 1997

[54] SHAPED-BEAM OR SCANNED BEAMS REFLECTOR OR LENS ANTENNA

[75] Inventors: Raimondo Lo Forti, Guidonia; Marco Lisi, Rome, both of Italy

[73] Assignees: Space Engineering S.p.A., Rome; Alenia Spazion SpA, L'Aquila, both of Italy

[21] Appl. No.: 442,142

[22] Filed: May 16, 1995

[30] Foreign Application Priority Data

May 17, 1994 [IT] Italy ..... RM94A0306

[51] Int. Cl.[6] ..... H01Q 13/00; H01Q 3/22

[52] U.S. Cl. ..... 343/781 R; 343/778; 342/372

[58] Field of Search ..... 343/781 R, 778, 343/700 MS, 754, 779; 342/371, 372, 373, 374, 375, 376, 365

[56] References Cited

U.S. PATENT DOCUMENTS

| | | | |
|---|---|---|---|
| 3,403,394 | 9/1968 | Rouault | 343/779 |
| 4,166,274 | 8/1979 | Reudink et al. | 342/376 |
| 4,799,065 | 1/1989 | Thompson | 343/779 |
| 4,814,775 | 3/1989 | Raab et al. | 342/374 |
| 4,939,527 | 7/1990 | Lamberty et al. | 343/754 |
| 5,327,147 | 7/1994 | Caille et al. | 343/754 |

*Primary Examiner*—Donald T. Hajec
*Assistant Examiner*—Tan Ho
*Attorney, Agent, or Firm*—Herbert Dubno

[57] ABSTRACT

Multiple shaped-beam or scanned beams reflector or lens antenna configured so as to have the radiating elements outside the focal plane (imaging) with improved characteristics in terms of gain and coverage area. Said antenna (FIG. 1) essentially consists of a reflector or a lens (1), a certain number of radiators (3) positioned outside the focal plane, a Beam Forming Network (BFN). It classifies in the technical field of multiple shaped-beam antennae and is applicable to radars, telecommunications in general and to space telecommunications in particular. Its most significant advantage consists in its use as transmitter antenna since in it the electric performance/complexity ratio is improved.

4 Claims, 4 Drawing Sheets

SHAPED-BEAM OR SCANNED BEAMS REFLECTOR OR LENS ANTENNA

SPECIFICATION

1. Field of the Invention

The present invention relates to a beam scan reflector or lens antenna which is configured so as to have the radiating elements outside the focal plane, a characteristic known in the specific field of antennae as "imaging".

The invention may be categorized in the field of multiple shaped-beam antennae and is applicable to radars, telecommunications in general and to space telecommunications in particular, in marine, ground, civil and military applications.

2. Background of the Invention

Prior antennas considered are:

2. "Semiactive parabolic antenna capable of continuous beam scanning by varying the phase only"—Italian Patent application No. RM91A000893.
2. "Semiactive parabolic antenna capable of providing shaped beams, to be used preferrably in space"—Italian Patent application No. RM91A000894.
3. "Phased array shaped-beam multiple beam antenna"—Italian Patent application No. RM94A000005.

The first two of the systems, described are focalized type reflector antennae, but are not of an imaging type, namely the feeds are in the focal plane, unlike the "imaging" optics which has the feeds outside the focal plane.

The use of imaging optics allows to make the BFN (beam-forming network) lighter and more compact.

SUMMARY OF THE INVENTION

The third type of antenna and the antenna which is the subject of this application for patent have in common that they are semiactive antennae with distributed amplifiers, always using all of the amplifiers fed at the same level in order to create shaped beams. However, the substantial difference between the two lies in the fact that the new antenna is not a direct radiating antenna, but consists of an array of radiating elements placed in front of a reflector or lens. The result is an antenna with better general performance characteristics, namely better gain an coverage area values.

According to the invention optics is introduced in invention consist in having introduced the optics in order to decrease the phased array antenna complexity. Compacting is obtained using the imaging technique, namely by positioning the radiating elements outside the focal plane.

The application of the single reflector imaging technique causes a deformation of the antenna beam, and consequently a degrading of the radioelectric performance: lower gain, higher sidelobes.

In order to recover the gain and the beam integrity and to lower the sidelobes, a specifically sized BFN (beam forming network) is added, thus preventing this imaging configuration from being degraded. In fact, the antanna's electrical performance is reintegrated by putting said BFN between the radiators and the amplifiers.

The antenna essentially consists of:

a reflector a given number of radiator positioned outside the focal plane and a beam forming network (BFN).

The problem we intend to solve with this invention is to overcome the main problem of the imaging configuration, represented by the fact that, depending on the direction of the signal origin, not all of the energy reflected by the reflector, or transmitted by the lens, is captured by the feeds since it shifted and therefore the feeds are not all fully illuminated. This implies a loss in terms of gain when one desired to maintain the amplifiers at the same power level.

In calculating this antenna's efficiency the reciprocity theorem was applied and then reversed should the antenna be used as transmitter, as is exactly the case in this invention.

The problem is solved by using a beam forming network positioned between the radiating elements and the amplifiers, so as to maintain the same power level at the amplifiers even when the feeds are fed at different power levels.

The beam forming network consists of number n of hybrids, of high power phase-shifting elements and of low power phase-shifting elements.

The topology, the connections and the phase values must be studied in order to obtain maximum radioelectric performance.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
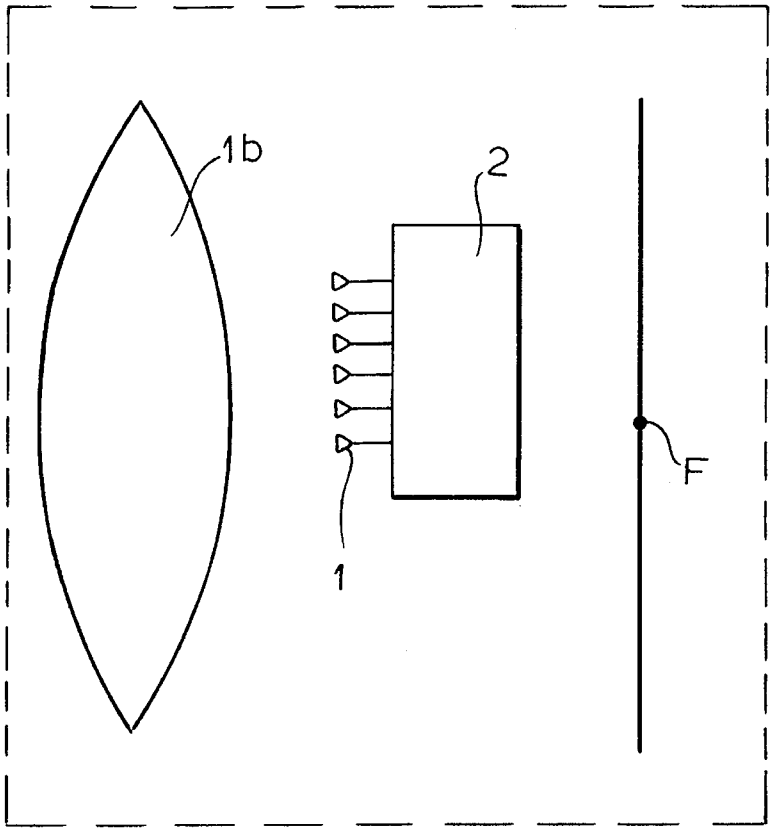
FIG. 1B is a diagram of a lens antenna system.
Figure 1A:
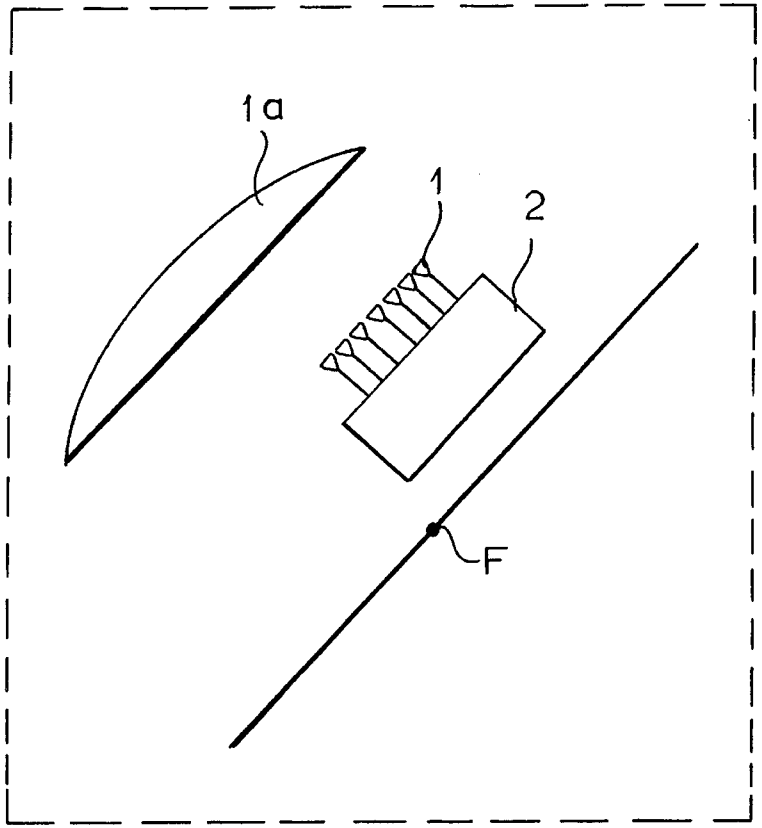
FIG. 1A is a diagram of a reflector antenna system.
Figure 2:
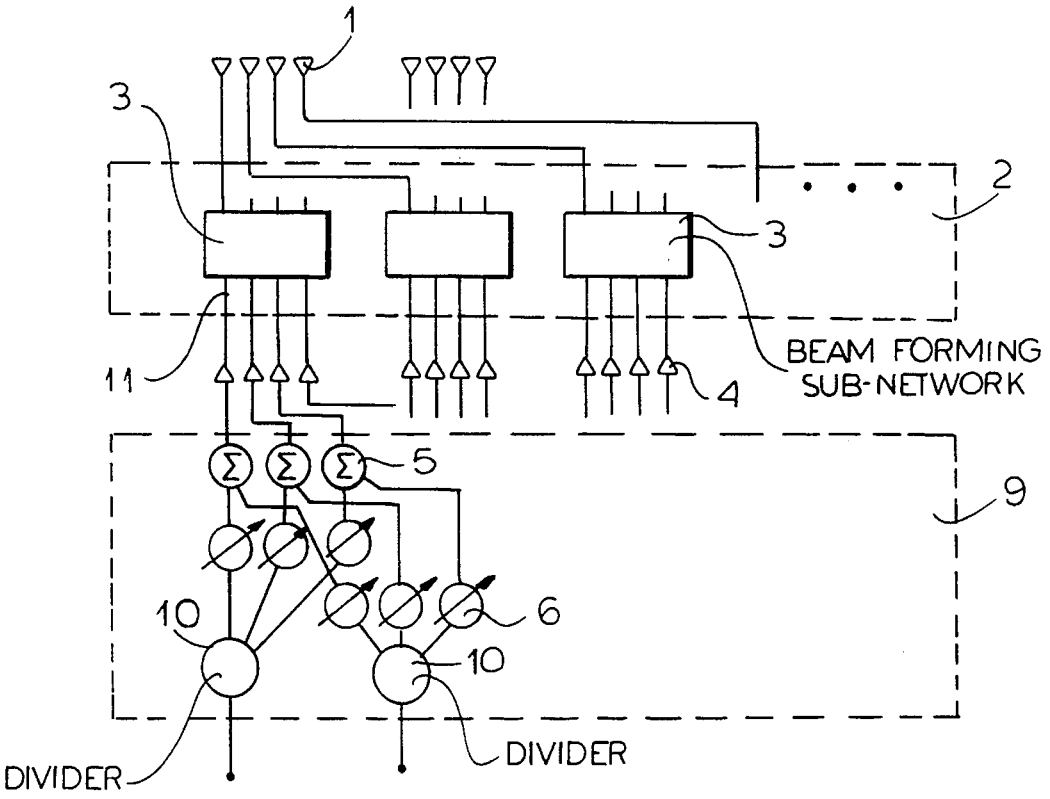
FIG. 2 is a block diagram of the BFN at low power level

The antenna of this invention basically comprises an optical system which can be a reflector 1*a*, (FIG. 1A) or a lens 1*b* (FIG. 1B), of a set of radiating elements or feeds 1, of a high power BFN (FIG. 3) or of a battery of amplifiers 4 and of a low power BFN (FIG. 2).

The high power BFN (FIG. 3) consists of a set of fixed phase shifters 8 and of a set of hybrids 7, connected between the input and out terminals 12, 13.

The high power BFN consists of a set of phase shifters 6, a given number of dividers 10 and a given number of adders 5, connected between the input terminals and the amplifiers 4.

The values of the low power phase shifters are specifically chosen for each direction of beam pointing, in the case of a scanning antenna, and in order to obtain an effective beam shaping in case of shaped-beam antenna.

The main feature of both systems lies in their capability to compensate for the aberrations introduced by the optics, whatever type it may be, by optimizing the high and low power BFN's.

Figure 3:
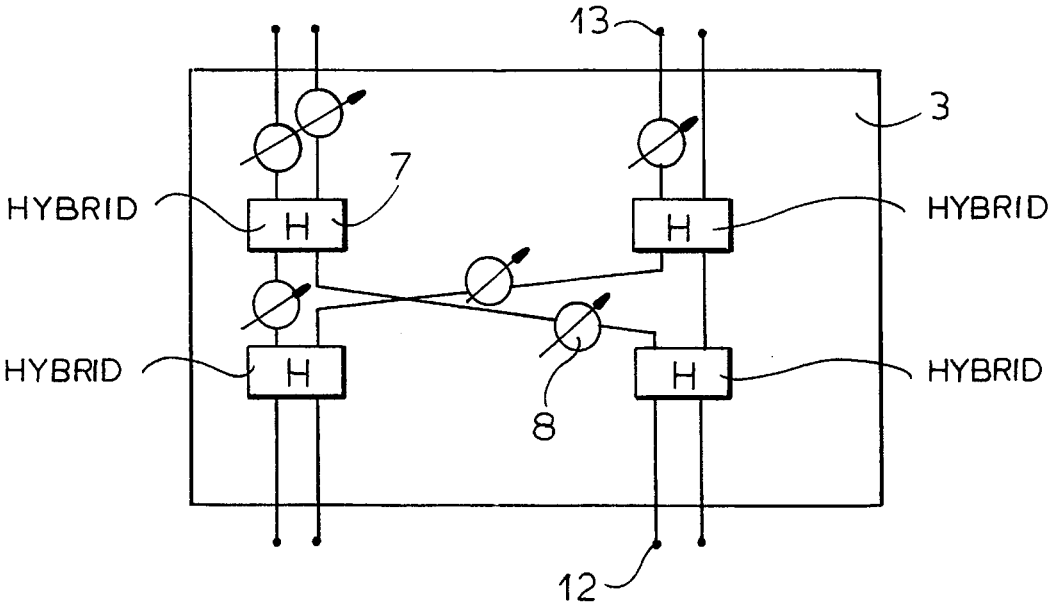
FIG. 3 is a block diagram of the beam forming network at high power level and of the assembly of amplifiers and of radiating element therefor.
Figure 4:
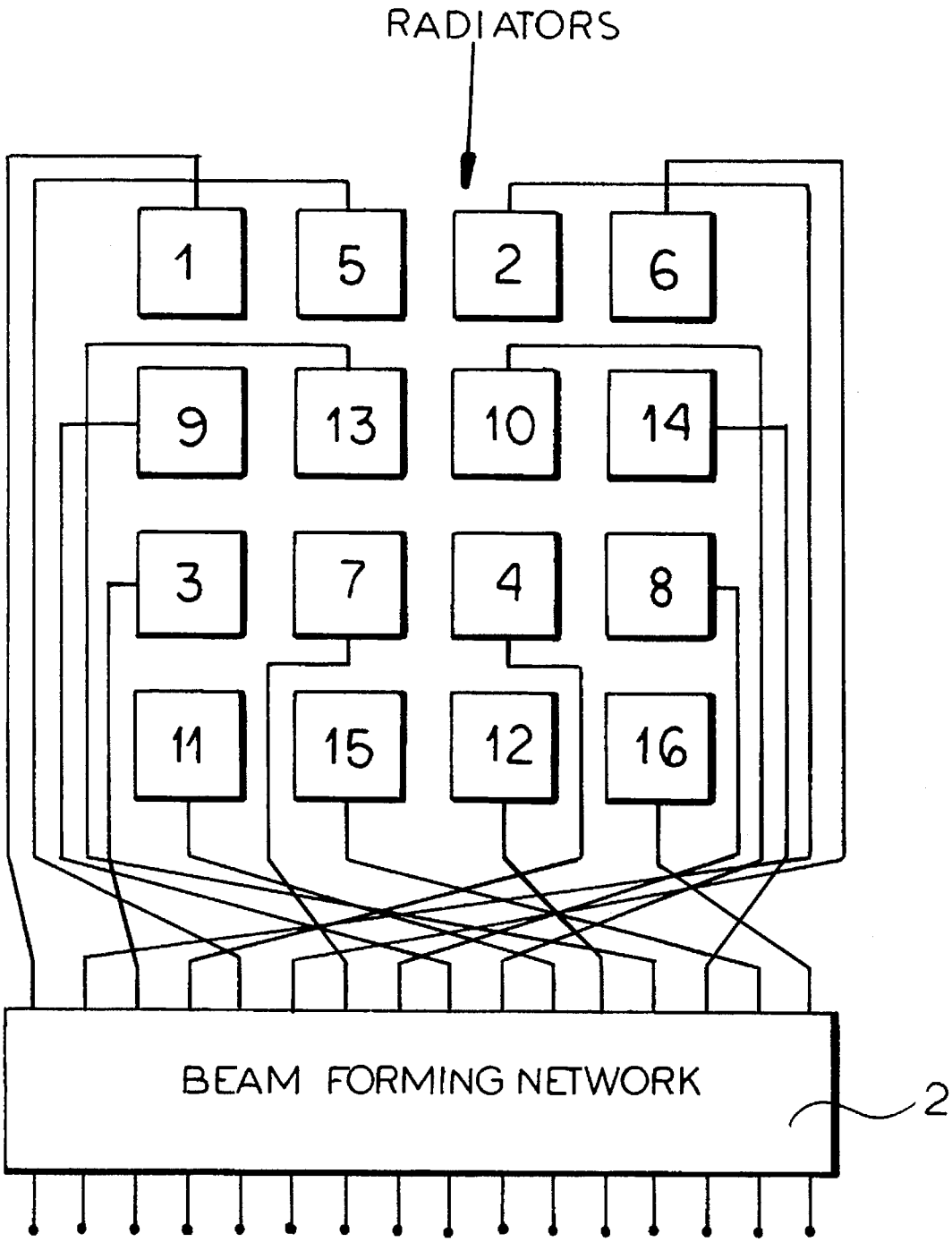
FIG. 4 is a diagram of connections between BFN output gates and radiating elements and FIG. 5 is a diagram of the envelope of the maximum gain values for all directions in UV space.

By "optimization" it is intended:

the choice of feed size and their distance from the focal plane;

the number and order of a plurality of sub-BFN's composing as a whole the BFN of FIG. 2;

the connection scheme between the high power BFN's outputs and the radiating elements (example in FIG. 4);

the phase values of the phase shifters in the low power BFN 9 (FIG. 2);

the phase values of the phase shifters 8 in the high power BFN (FIG. 3).

Figure 5:
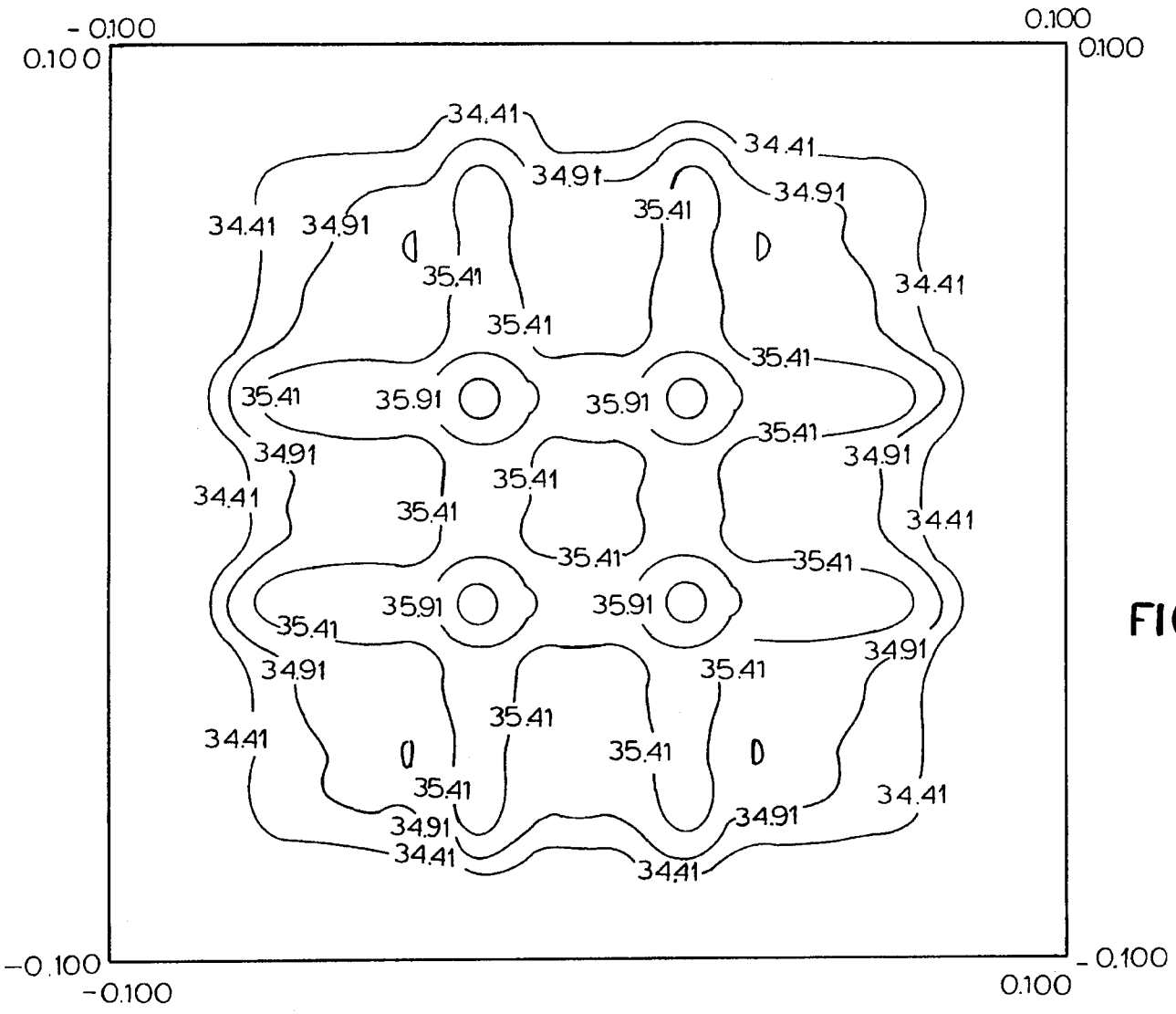

From all of the above one may infer that the specific scope of this invention consists in optimizing all those parameters in such a way that, once the optics' size and the number of radiating elements is determined, the directivity value and the size of the scan sector are increased (FIG. 5), while maintaining the same RF operating point for all power amplifiers. This allows the latter to obtain maximum efficiency possible. Moreover, should one desire to create shaped beams, this technique allows to maximize the minimum values in each beam.

The shaped-beam or scanned-beam reflector or lens antennas can consist of a passive network positioned between radiators and power amplifiers and a conventional network 9, with the radiating elements or feeds positioned outside the focal plane. The passive network can consist of any number of high power beam forming subnetworks 3 in which the input signals 12 and the output signals 13 pass through a series of hybrids 7 and phase shifters 8. The network 9 can contain dividers 10, phase shifters 6, and adders 5 which are connected by means of connection lines 11 to the passive network 2. The signal related to the i-th beam is initially divided into n signals which are specifically phase-shifted before feeding the power amplifiers 4 and amplifiers 4 are in turn connected to the passive network consisting of the hybrids 7 and phase shifters 8.

We claim:

1. A beam-type antenna system comprising:

an array of radiators defining an antenna beam;

antenna optics spaced from said array of radiators for focussing said beam and having a focal plane such that said array lies between said antenna optics and said focal plane and said array is outside said plane;

a passive main beam forming network connected to said array of radiators and comprising a plurality of beam forming subnetworks, each connected to a group of said radiators, each of said beam forming subnetworks being provided with pairs of input terminals, respective hybrids connected to said pairs of input terminals, respective phase shifters connected between said hybrids and respective output terminals, and further phase shifters connecting said hybrids of one pair of input terminals with hybrids of another pair of input terminals; and respective power amplifiers connected to said input terminals.

2. The beam-type antenna system defined in claim 1 wherein a further network is connected to said passive main beam forming network and comprises: a plurality of dividers, respective phase shifters connected to said dividers and respective adders receiving inputs from phase shifters of different dividers and connected to said power amplifiers.

3. The beam-type antenna system defined in claim 2 wherein said antenna optics is a reflector.

4. The beam-type antenna system defined in claim 2 wherein said optics is a lens.

* * * * *

UNITED STATES PATENT AND TRADEMARK OFFICE

CERTIFICATE OF CORRECTION

PATENT NO. : 5,598,173

DATED : January 28, 1997

INVENTOR(S) : Raimondo LO FORTI et al

It is certified that error appears in the above-indentified patent and that said Letters Patent is hereby corrected as shown below:

On the title page, item [73]:

Assignees: Space Engineering S.p.A., Rome;
Alenia Spazio SpA, L'Aquila,
both of Italy Signed and Sealed this Twelfth Day of August, 1997

*Attest:*

*Attesting Officer*

BRUCE LEHMAN

*Commissioner of Patents and Trademarks*